US005142974A

United States Patent [19]

Fletcher

[11] Patent Number: 5,142,974

[45] Date of Patent: Sep. 1, 1992

[54] APPARATUS HAVING A PIVOTABLE ARM FOR CRUSHING CANS

[76] Inventor: John H. Fletcher, 1508 58th St. North, St. Petersburg, Fla. 33710

[21] Appl. No.: 798,516

[22] Filed: Nov. 26, 1991

Related U.S. Application Data

[63] Continuation-in-part of Ser. No. 548,268, Jul. 5, 1990, Pat. No. 5,069,121.

[51] Int. Cl.[5] ..... B30B 9/32; B30B 7/00

[52] U.S. Cl. ..... 100/137; 100/233; 100/293; 100/902

[58] Field of Search ..... 100/137, 233, 236, 237, 100/293, 902; D15/123

[56] References Cited

U.S. PATENT DOCUMENTS

| | | | |
|---|---|---|---|
| D. 240,074 | 5/1976 | Smith | 100/902 X |
| D. 268,761 | 4/1983 | Brown | 100/902 X |
| D. 287,015 | 12/1986 | Berry | 100/902 X |
| 334,212 | 1/1886 | Badger | 100/233 |
| 886,401 | 5/1908 | Pickett | 100/293 X |
| 1,402,433 | 1/1922 | Monroe | 100/902 X |
| 2,161,931 | 6/1939 | Pattison | 100/902 X |
| 2,466,907 | 4/1949 | Nadolny et al. | 100/902 X |
| 2,602,483 | 7/1952 | Graham | 100/902 X |
| 2,603,271 | 7/1952 | Heymers | 100/902 X |
| 2,800,160 | 7/1957 | Wilson et al. | 100/902 X |
| 2,905,079 | 9/1959 | Brock | 100/902 X |
| 3,667,386 | 6/1972 | Workman | 100/902 X |
| 3,948,164 | 4/1976 | Pobuda et al. | 100/902 X |
| 4,058,054 | 11/1977 | Markman | 100/902 X |
| 4,292,891 | 10/1981 | Shelley | 100/902 X |
| 4,333,396 | 6/1982 | Longnecker | 100/902 X |
| 4,333,397 | 6/1982 | Modes | 100/902 X |
| 4,383,480 | 5/1983 | Jerden | 100/902 X |
| 4,393,765 | 7/1983 | Accettura et al. | 100/902 X |
| 4,442,768 | 4/1984 | Bailey | 100/902 X |
| 4,459,905 | 7/1984 | Wilson | 100/902 X |
| 4,532,861 | 8/1985 | Gisselberg, III | 100/902 X |
| 4,561,351 | 12/1985 | Ader | 100/902 X |
| 4,884,502 | 12/1989 | Stacey, Jr. | 100/902 X |

FOREIGN PATENT DOCUMENTS

| | | | |
|---|---|---|---|
| 3307842 | 9/1984 | Fed. Rep. of Germany | 100/902 |
| 786764 | 9/1935 | France | 100/233 |
| 58-23598 | 2/1983 | Japan | 100/902 |
| 58-138598 | 8/1983 | Japan | 100/902 |
| 1-218799 | 8/1989 | Japan | 100/902 |
| 282745 | 8/1952 | Switzerland | 100/233 |
| 2058656 | 4/1981 | United Kingdom | 100/233 |

*Primary Examiner*—Harvey C. Hornsby
*Assistant Examiner*—Stephen F. Gerrity
*Attorney, Agent, or Firm*—Walter J. Monacelli

[57] ABSTRACT

The can crushing device disclosed herein comprises a base plate which has an upper movable arm pivotally connected at one end of the base plate, said base plate having an arm rigidly connected to said base plate with the rigid arm having its upper surface substantially in the same plane as the upper surface of said base plate and said arm being connected to said base plate at a position other than the end of said base plate where said movable arm is connected. The movable arm has a bar rigidly connected thereto and extending substantially perpendicularly therefrom and in a position to come down on said arm rigidly connected to said base plate. With a partially crushed can positioned on said base plate and an uncrushed can positioned on said arm rigidly connected to said base plate it is possible with one downward movement of the movable arm to complete crushing of the partially crushed can and to simultaneously partially crush the uncrushed can on the rigidly connected arm extending from the base plate by the simultaneous downward movement of the bar extending from the upper movable arm.

13 Claims, 3 Drawing Sheets

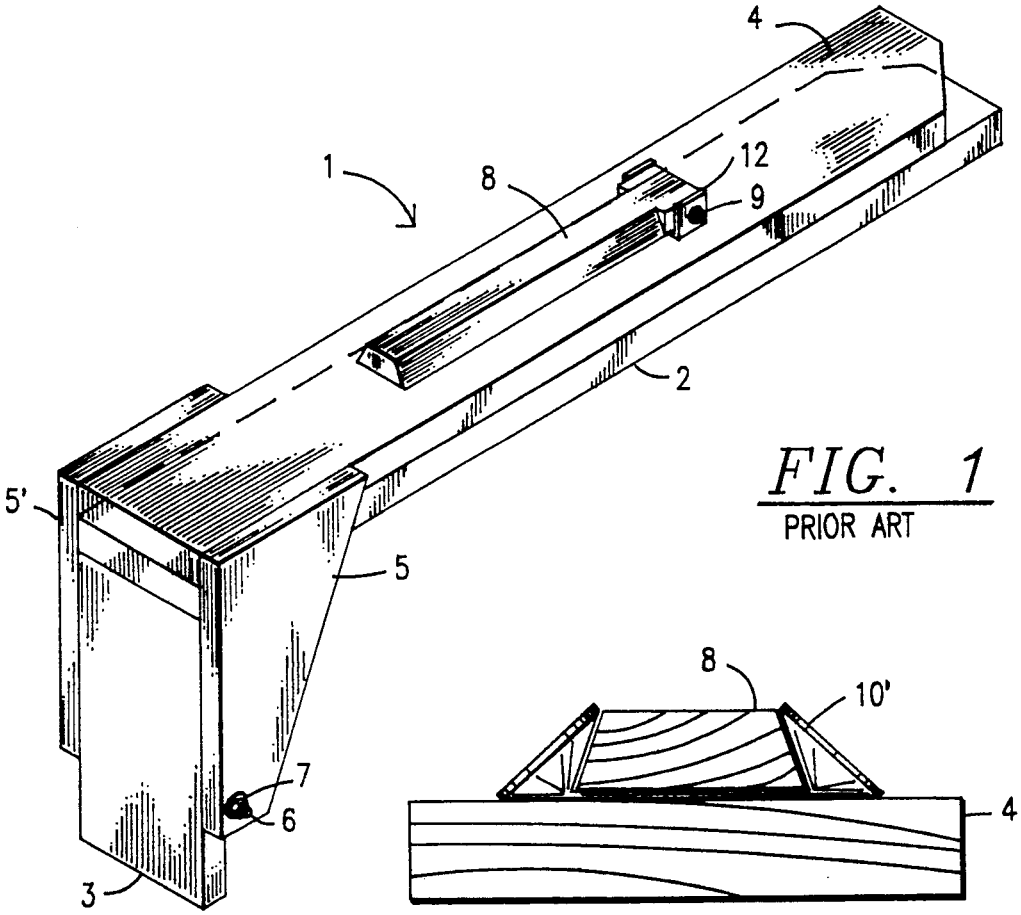
FIG. 1
PRIOR ART
FIG. 2
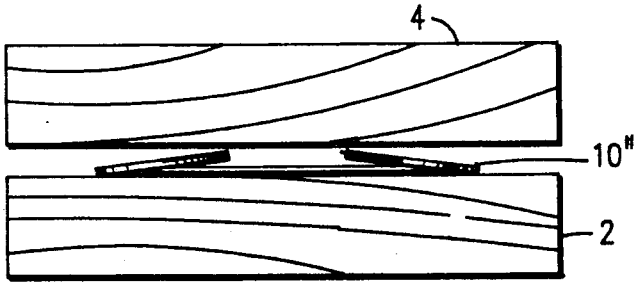
FIG. 3

APPARATUS HAVING A PIVOTABLE ARM FOR CRUSHING CANS

This application is a continuation-in-part of application Ser. No. 07/548,268 filed Jul. 5, 1990, issued as U.S. Pat. No. 5,069,121 issued Dec. 3, 1991.

BACKGROUND OF THE INVENTION

1. Field of the Invention

This invention relates to a device for crushing empty metal cans, such as aluminum cans. More specifically it relates to a two part compactor in which a first part bends in or caves in the middle portion of the can. Still more specifically the second part of the compactor crushes the thus bent can into one compact piece. Even more specifically the two part compactor may be combined in one device by having the first part positioned on or fastened to the second part. Still more specifically this improved invention relates to a compactor in which a partially crushed can is completely crushed and a second can is partially and simultaneously crushed by one operation of the device.

2. State of the Prior Art

Both for ecological or environmental reasons and for the recovery of a valuable metal, metal cans, particularly aluminum cans, are being collected and deposited in recycling collection depots. In order to reduce the volume occupied by the collected cans it is desirable to crush the cans to minimize the volume occupied. Since cans are often collected by individuals who do not have the space or containers in which to store these cans until they are taken to a collection depot, it is desirable therefore to have a simple device to crush the cans into compact units.

The desire and need for such a compactor is illustrated by the number of patents directed to such devices. Typical are the following U.S. Pat. Nos.: 334,212; 886,401; 1,402,433; 2,161,931; 2,466,907; 2,603,271; 2,800,160; 2,905,079; 3,667,386; 3,948,164; 4,058,054; 4,292,891; 4,333,396; 4,333,397; 4,383,480; 4,393,765; 4,442,768; 4,459,905; 4,532,861; 4,561,351; 4,884,502; U.S. Pat. Nos. Des. 240,047; 268,761 and 287,015; French patent 786,764; Swiss patent 282,745; British patent 2,058,656; and Japanese patents 58-23598 and 1-218,799. Most of these are complicated devices which attempt to crush the cans by pressure applied to the ends of the cans or by initially crushing the ends of the cans.

Applicant has been granted U.S. Pat. No. 5,069,121 on a can crushing apparatus which first in one operation partially crushes a can and then in a second operation completes the crushing of the can. It would be advantageous to have one operation complete the crushing of a partially crushed can and simultaneously perform the partial crushing of another can.

OBJECTIVES

It is an object of this invention to have a simple device to initiate the crushing of the can by attacking the vulnerable sidewall of the can.

It is also an object of this invention to have the can conditioned to a more easily crushable shape by this sidewall crushing which tilts the ends of the cans to a more easily crushable state.

It is also an object of this invention to have a simple inexpensive device which will complete the crushing of cans to compact flat pieces.

It is also an object of this invention to have a simple inexpensive device which will effect a partial crushing of one can and simultaneously complete the crushing of another partially crushed can.

These and other objectives as described hereinafter are capable of being met by the device of this invention.

STATEMENT OF THE INVENTION

In accordance with the present invention it has been found that the above objectives are fully met by the operation of the improved device of this invention. This device comprises a base plate on which a partially crushed can, such as an aluminum beverage can, is positioned, and a movable arm which can be moved downward to lie flat on the base plate. The base plate and the arm each have one or two legs extending downward from the end thereof; the respective ends of the base plate and the movable arm are adjacent to each other. The leg or legs of the movable arm is/are pivotally attached to the leg of the base plate by one or preferably two hinges or pivot bolts at a point or points spaced from the base plate, preferably at a distance of 6 to 10 inches from the base plate. By lifting that end of the movable arm opposite the end attached to the leg of the base plate, as described above, the leg of the movable arm is pivoted with respect to the base plate leg and the movable arm is lifted away from the base plate. While the movable plate is in such a raised position, a partially crushed can may be positioned on the base plate and the movable arm moved back toward the base plate resulting in the complete and compact crushing of the can.

The pivoting of the movable arm leg about the point of connection to the base plate leg allows a lowering of the movable arm onto a can on the base plate thereby applying force on the can more directly from the top of the can. In comparison, if the movable arm is hinged directly to the base plate, lowering of the movable arm produces wedge type action on the can which causes a skittering or sliding of the can on the surface of the base plate. The type of pivoting connection described above permits a can to be placed as close as 3–4 inches from the end of the base plate without lateral move of the can when the movable arm is lowered thereon. This means that all but about 4 inches of the length of the movable arm may be used as leverage in crushing the can.

As distinguished from the can crushing device of applicant's U.S. Pat. No. 5,069,121 the base plate has a rigid arm fixed to the base plate and extending sidewards or backwards from the unhinged end of the base plate, having its upper surface substantially an extension of the upper surface of the base plate, and the movable arm has a bar extending from the side or rear end thereof positioned so as to be superimposed on the base plate rigidly fixed arm when said movable arm is moved to or resting on the base plate. Advantageously the rigid arm has a groove on the upper surface thereof on which an uncrushed can may be placed so that when the movable arm is moved downward to approach or rest substantially on the base plate, the bar extending from the movable arm will press against a can resting on the groove and an initial crushing of the can will be effected. By placing a partially crushed can on the base near that end to which the movable arm is indirectly connected, and by placing a completely uncrushed can on the rigid arm, one downward movement of the movable arm will complete the crushing of the partially crushed can on the base plate and partially crush the can on the rigid arm.

The pressure of the bar against the side of a can will cause the side of the can to cave in and to tilt the ends of the can toward the middle of the can. When the crushing of the can is eventually completed as described above, the tilted ends of the can are brought flat against the rest of the can to give a compact, flat substantially uniform size for similar size cans.

In addition to the simultaneous one movement completion of crushing of a partially crushed can and the effecting of partial crushing of a second can, the can crushing device of this invention has a number of advantages including ease of operation, uniformity of size in compacted product, sharp edges not produced in product, exertion of considerable pressure on can, useful for different sizes of cans, etc.

In one modification of the invention the base plate and the movable arm may be made of 2×4 inch planks. The leg attached to the base plate may also be a 2×4 inch board and the legs attached to the movable arm may comprise two rectangular pieces of ½ or ¾ inch plywood paneling with a pivot bolt passing through an opening in a lower end of each of the rectangular pieces or side plates and fastened into opposite sides of the base plate leg. A cross piece may be rigidly fastened at the bottom of the base plate leg to brace against tipping of the apparatus. In such a modification the base plate and the movable arm advantageously are approximately 36 inches long and the base plate leg may be approximately 12–18 inches long. The openings in the side plates may be positioned approximately 6–10 inches perpendicularly from the bottom of the movable arm. With the two side plates an open space is made available at the end of the base, plate so that the crushed can can be slid off the end of the base plate into a container positioned under the base plate leg. Opposite corners of the unhinged ends of the base plate and the movable arm may be cut off to facilitate lifting of the movable arm and holding down of the base plate. This device may be advantageously placed on a counter or table with the legs hanging over the edge and above a container into which the crushed cans are to be dropped. It is also possible to have a second supporting leg at the unhinged end of the base place to complete support of the crushing apparatus. To avoid tipping of the apparatus a brace may be fastened at the lower end of the base plate leg which also serves as a first support leg.

In a similar modification the base plate, the movable arm and the legs may be made of metal or a strong plastic provided they can give the required crushing strength.

In another modification the leg or legs for the movable arm may be one piece or two pieces hinged at the bottom end to the leg of the base plate so that the movable arm can be tilted as described above. In such modification two legs are preferred with a sufficient space between the two legs so that the crushed can can be dropped off the end of the base plate. With such legs on the movable arm it is desirable to reinforce their connection to the movable arm by right angle plates.

The bar extending sidewards or backwards from the movable arm is a narrow bar, preferably 1.5 to 2 inches wide, which, when pressed against the side of a can resting on the rigid arm extending from the base plate, causes the side of the can to be caved inwardly and the ends of the can to be tilted toward the middle of the can. This preliminary crushing prepares the can for the final, complete crushing to be effected eventually by the movable arm as described above.

SPECIFIC EMBODIMENT OF THE INVENTION

The device of this invention may be further described by reference to the drawings in which:

FIG. 1 is a perspective view of the device shown in applicant's U.S. Pat. No. 5,069,121.

FIG. 2 is a cross-sectional end view of a bar causing the partial crushing of a can.

FIG. 3 is a cross-sectional end view showing how the partially crushed can FIG. 2 is completely crushed.

Figure 4:
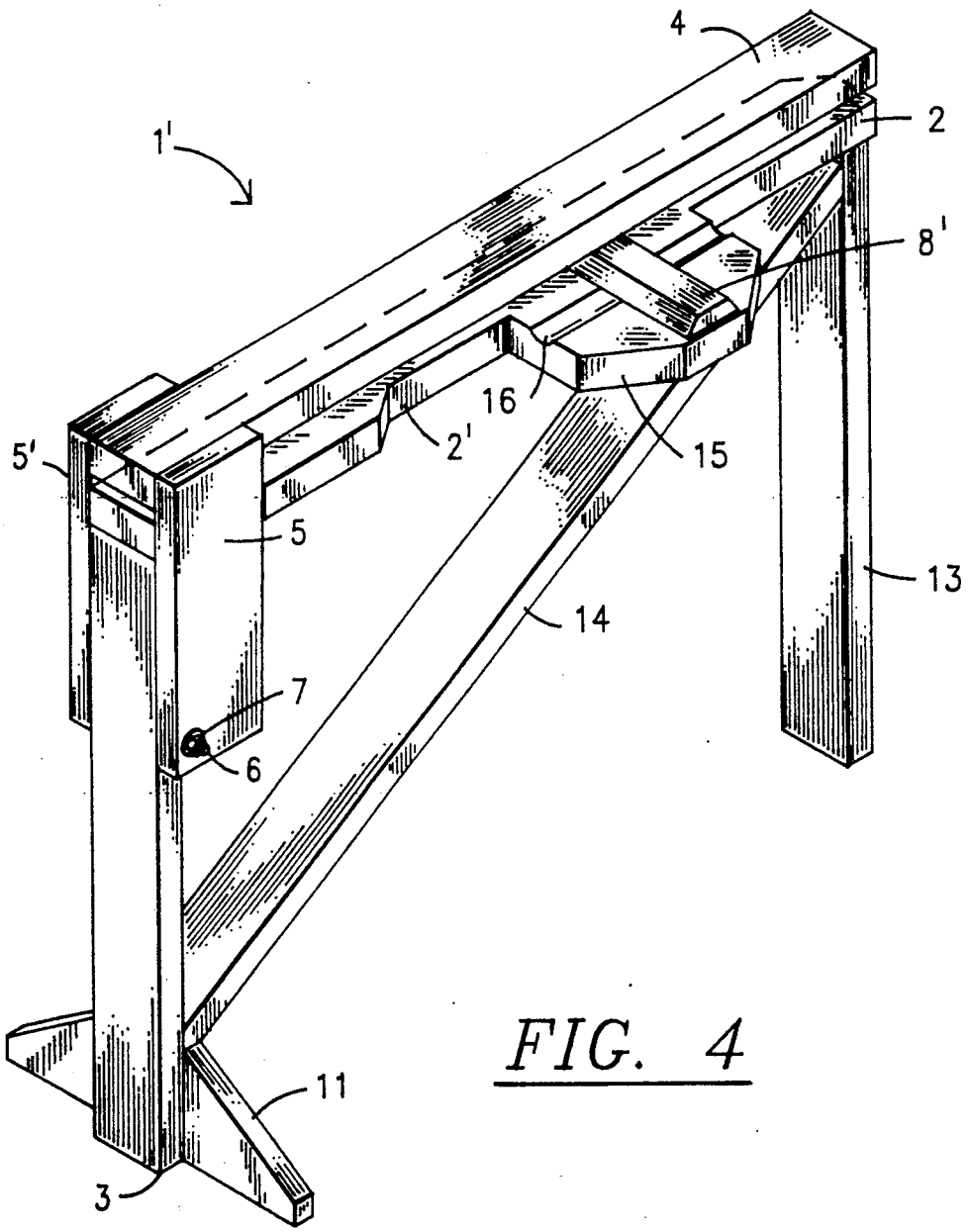
FIG. 4 is a perspective view of a preferred self-supporting modification of the present invention showing a rigid arm extending sidewards from the base plate and a bar extending sidewards from the movable arm.

As shown in FIG. 1, compact crusher 1 has a base plate 2 with leg 3 extending downward at one end. Movable arm 4 has two legs or panels 5 and 5' extending downward from one end thereof in the vicinity of leg 3. Legs 5 and 5' are pivotally joined to leg 3 by bolt 6. Nut 7 may be used to retain bolt 6 in position. An auxiliary bar 8 may be positioned on the upper surface of movable arm 4 and fastened thereto by pivoting means or hinge 9. As described hereinafter this auxiliary bar may be positioned elsewhere but is used to press the side of a can to cause an initial caving in of the sidewall of the can. In FIG. 2 this initial crushing of can 10 by bar 8 is shown. Bar 8 is shown in a preferred truncated prism cross-section. This preliminary crushing of the can causes the ends of the can to be tilted inwardly toward the center of the can.

Figure 5:
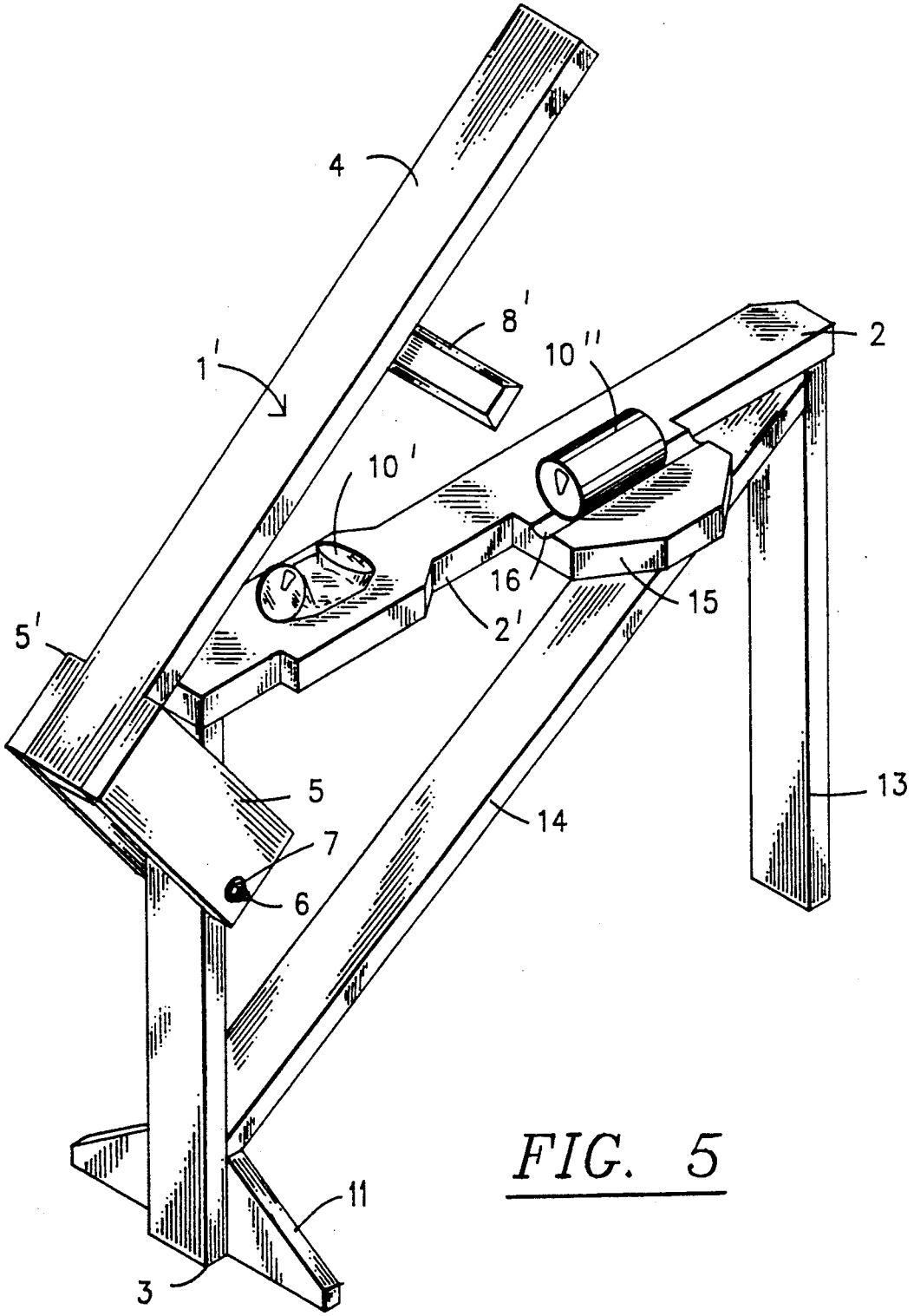
FIG. 5 is a perspective view of the modification of FIG. 4 with the movable arm in a raised position and a partially crushed can and an uncrushed can in position for crushing.

After the preliminary crushing the can is placed on the base plate 2 while movable arm 4 is in a raised position as shown in FIG. 5. Preferably can 10 is positioned approximately 4–10 inches from the joined end of base plate 2.

FIG. 3 shows by cross-section of arm 4 and base plate 2 the resulting crushed condition of can 10''.

In FIG. 4 leg 13, in addition to leg 3 making the device self-supporting cross-piece 11 braces the device against tipping over and bracing beam 14 gives additional support to the structure. Rigid arm 15 extends from base plate 2 with its upper surface and the upper surface of the rigidly fixed arm being substantially in the same plane. Groove 16 in arm 15 provides a positioning arrangement for a can to receive the preliminary partial crushing when bar 8' is pressed down on the can.

FIG. 5 shows movable arm 4 in a raised position so that partially crushed can 10' is placed on the base plate and uncrushed can 10'' is placed on groove 16 for subsequent partial crushing by bar 8'. It is contemplated that, in addition to having rigid arm 15 extend from either side of base plate 2, this arm may be fixed to the unhinged end, or rear end of base plate 2, and a can placed thereon can be partially crushed by having bar 8' extend backward from movable arm 4 and positioned so as to come down on the can from above the rear attached rigid arm.

As previously pointed out, the advantage of having the rigid arm 15 and bar 8' positioned above the rigid arm is that by one downward stroke of movable arm 4, completion of the crushing of a partially crushed can 10' and the initial crushing of uncrushed can 10' can be simultaneously effected. This can expedite the crushing of a large number of cans and reduce the effort required.

As also previously pointed out, an advantage of having an open space between the legs 5 and 5' descending from movable arm 4 is that after the can is crushed and arm 4 is raised, the crushed can can be pushed off the end of the base plate, through the open space between the arm legs and into a container placed below that end of the crusher.

With the bar 8' fastened to the underside of movable arm 4, the thickness of bar 8' is an important factor. If the bar is very thin the thickness of the bar will not interfere with the arm 4 completely crushing the partially crushed can on the base plate. Where the thickness of the bar will interfere with a complete crushing this may be compensated for by having a plate of appropriate thickness on the base plate under the can. Such a plate is preferably of metal to prevent abrading of the area under the can.

In addition to the arrangement described above, base plate 2 may be fastened as a shelf to a wall instead as standing as a table according to the above description.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. A can crushing device comprising:

(a) a base plate having a planar upper surface and a width sufficient to accommodate thereon the length of the can to be crushed, having a length substantially greater than the width and having at least one leg extending perpendicularly downward from one end thereof for a distance of 6 to 18 inches; said base plate having an arm rigidly connected thereto and extending outwardly therefrom, the upper surface of said rigidly connected arm being in substantially the same plane as the upper surface of said base plate said arm being positioned on said base plate a substantial distance from that end thereof to which said at least one leg is extended.

(b) a movable arm having a width sufficient to cover the length of the can to be crushed, having a length sufficient to give the leverage required for crushing the can, and having at least one leg extending perpendicularly downward from one end thereof for a distance of at least 6 inches, said arm having the other end of said arm unattached, said at least one leg on said arm being positioned adjacent to said at least one leg on said base plate, said movable arm having rigidly connected thereto a bar having width of 1–2.5 inches and extending outwardly therefrom and positioned so that when said movable arm is moved downward said bar will come downward toward the arm rigidly connected to said base plate whereby the bar will partially crush a can positioned on said rigidly connected arm;

(c) a pivoting means positioned at least 6 inches below said base plate and connecting said at least one leg on said arm to said at least one leg on said base plate, and adapted to allow said arm to lay flat on said base plate and also to allow said arm to be moved away form said base plate by lifting the unattached end of said arm away from said base plate;

whereby a can positioned on said base plate between said base plate and said arm can be crushed by a force applied to the unattached end of said arm and directed toward said base plate and simultaneously a can positioned on said arm rigidly connected to said base plate will be partially crushed by said bar rigidly connected to said movable arm.

2. The device of claim 1 in which said at least one leg extending downward from said base plate is one leg having a width corresponding to the width of said base plate.

3. The device of claim 2 in which said pivoting means is positioned 6 inches below said base plate.

4. The device of claim 1 in which said at least one leg extending downward from said arm comprises two legs for which the width of the two legs plus the space therebetween corresponds to the width of the said base plate and said two legs are hinged at their bottom to said at least one leg of said base plate to provide said pivoting means.

5. The device of claim 1 in which said bar has a width of 1.5–2 inches.

6. The device of claim 1 in which said bar has a linear axis and is positioned at one side of said arm.

7. The device of claim 6 in which said arm rigidly fixed to said base plate has a groove at the upper surface thereof whereby when an uncrushed can is positioned thereon it will have its linear axis at an angle of approximately 90° with the linear axis of said bar.

8. The device of claim 7 in which said pivoting means is positioned 6–12 inches below said base plate.

9. The device of claim 1 in which said movable arm has a length in the range of 24–40 inches.

10. The device of claim 9 in which said movable arm has a length of approximately 36 inches.

11. The device of claim 9 in which said base plate has a length in the range of 24–40 inches.

12. The device of claim 11 in which said base plate has a length of approximately 36 inches.

13. The device of claim 1 in which said pivoting means is positioned 6–12 inches below said base plate.

* * * * *

UNITED STATES PATENT AND TRADEMARK OFFICE

CERTIFICATE OF CORRECTION

PATENT NO. : 5,142,974

DATED : September 1, 1992

INVENTOR(S) : JOHN S. FLETCHER

It is certified that error appears in the above-identified patent and that said Letters Patent is hereby corrected as shown below:

On the title page, item [76] Inventor:

The middle initial in patentee's name should be changed from "H" to read "S".

Signed and Sealed this

Twenty-eighth Day of September, 1993

*Attest:*

*Attesting Officer*

BRUCE LEHMAN

*Commissioner of Patents and Trademarks*